US010773920B2

(12) United States Patent
Crozier

(10) Patent No.: US 10,773,920 B2
(45) Date of Patent: Sep. 15, 2020

(54) HOSE RACK SYSTEM

(71) Applicant: UNITED RENTALS, INC., Seal Beach, CA (US)

(72) Inventor: Rickey L. Crozier, Chicago Heights, IL (US)

(73) Assignee: UNITED RENTALS, INC., Stamford, CT (US)

( * ) Notice: Subject to any disclaimer, the term of this patent is extended or adjusted under 35 U.S.C. 154(b) by 0 days.

(21) Appl. No.: 16/269,363

(22) Filed: Feb. 6, 2019

(65) Prior Publication Data

US 2019/0241395 A1 Aug. 8, 2019

Related U.S. Application Data

(60) Provisional application No. 62/627,110, filed on Feb. 6, 2018.

(51) Int. Cl.

| | |
|---|---|
| ***B65H 75/00*** | (2006.01) |
| ***B65H 75/04*** | (2006.01) |
| ***A47B 81/00*** | (2006.01) |
| ***A47B 87/02*** | (2006.01) |

(52) U.S. Cl.

CPC ..... *B65H 75/04* (2013.01); *A47B 81/00* (2013.01); *A47B 87/0207* (2013.01); *B65H 2701/33* (2013.01)

(58) Field of Classification Search

CPC ..... A47B 47/0083; A47B 47/0058; A47B 96/024; A47B 47/00; A47B 43/00

USPC ..... 248/68, 74.1, 74.3, 80, 83, 89; 211/194

See application file for complete search history.

(56) References Cited

U.S. PATENT DOCUMENTS

| | | | | |
|---|---|---|---|---|
| 3,945,501 | A * | 3/1976 | Jay | B65D 61/00 211/194 |
| 4,191,112 | A * | 3/1980 | Maldonado | B65D 19/08 108/53.3 |
| 4,266,678 | A * | 5/1981 | Daly | A47B 87/0215 211/194 |
| 5,330,058 | A * | 7/1994 | Rice | A47F 5/01 211/189 |
| 5,695,205 | A * | 12/1997 | Liu | A47B 87/0246 211/189 |
| 5,722,544 | A * | 3/1998 | Williams | A47B 87/008 108/107 |
| 7,967,157 | B2 * | 6/2011 | Bilotto | A47F 5/13 211/182 |
| 8,919,363 | B1 * | 12/2014 | Johnson | A47F 7/0035 135/128 |

(Continued)

*Primary Examiner* — Steven M Marsh

(74) *Attorney, Agent, or Firm* — K&L Gates LLP

(57) ABSTRACT

A rack assembly that includes first and second side wall assemblies, a mid center bar extending between the first and second side wall assemblies, first and second front cradle bars extending between the first and second side wall assemblies, first and second male nesting members secured to the top of the first side wall assembly, first and second female nesting members secured to the bottom of the first side wall assembly, third and fourth male nesting members secured to the top of the second side wall assembly, and third and fourth female nesting members secured to the bottom of the second side wall assembly. A front cradle space is defined between the first and second front cradle bars and a rear cradle space is defined between the first and second rear cradle bars.

8 Claims, 10 Drawing Sheets

(56) References Cited

U.S. PATENT DOCUMENTS

| | | | | |
|---|---|---|---|---|
| 9,247,809 | B1 * | 2/2016 | Hsu | A47B 96/021 |
| 2004/0222179 | A1 * | 11/2004 | Garcia | A47B 87/0223 211/206 |

* cited by examiner

HOSE RACK SYSTEM

CROSS REFERENCE TO RELATED APPLICATIONS

This application claims the benefit of U.S. Provisional Application No. 62/627,110, filed Feb. 6, 2018, the entirety of which is incorporated herein by reference.

FIELD OF THE INVENTION

The present invention relates generally to a hose rack system, and more particularly to a hose rack system that is stackable.

BACKGROUND OF THE INVENTION

A need exists for a system where hoses can be stored on racks and the various racks can be stacked on top of one another.

SUMMARY OF THE PREFERRED EMBODIMENTS

In accordance with a first aspect of the present invention there is provided a rack assembly that includes first and second side wall assemblies, a mid center bar extending between the first and second side wall assemblies, first and second front cradle bars extending between the first and second side wall assemblies, first and second male nesting members secured to the top of the first side wall assembly, first and second female nesting members secured to the bottom of the first side wall assembly, third and fourth male nesting members secured to the top of the second side wall assembly, and third and fourth female nesting members secured to the bottom of the second side wall assembly. A front cradle space is defined between the first and second front cradle bars and a rear cradle space is defined between the first and second rear cradle bars. In a preferred embodiment, a ground clearance is defined below the first front cradle bar, second front cradle bar, first rear cradle bar and second rear cradle bar. Preferably, the rack assembly includes a top center bar extending between the first and second side wall assemblies. The top center bar is spaced above the mid center bar.

In a preferred embodiment, the first wall assembly includes first and second corner posts and a first bottom side bar that extends between the first and second corner posts, and the second wall assembly includes third and fourth corner posts and a second bottom side bar that extends between the third and fourth corner posts. The front cradle bars extend between the first and second bottom side bars, and the rear cradle bars extend between the first and second bottom side bars. Preferably, the first wall assembly includes a first mid side bar that extends between the first and second corner posts, and the first mid side bar is spaced above the first bottom side bar. Preferably, the second wall assembly includes a second mid side bar that extends between the third and fourth corner posts, and the second mid side bar is spaced above the second bottom side bar.

In a preferred embodiment, the first wall assembly also includes a first top side bar that extends between the first and second corner posts, and the first top side bar is spaced above the first mid side bar. Preferably, the second wall assembly includes a second top side bar that extends between the third and fourth corner posts, and the second top side bar is spaced above the second mid side bar. In a preferred embodiment, the first wall assembly includes first and second front vertical side bars extending between the first top side bar and the first mid side bar and first and second rear vertical side bars extending between the first top side bar and the first mid side bar. Preferably, the second wall assembly includes third and fourth front vertical side bars extending between the second top side bar and the second mid side bar and third and fourth rear vertical side bars extending between the second top side bar and the second mid side bar.

In a preferred embodiment, the first and second front vertical side bars are coplanar with the first and second front cradle bars and the third and fourth vertical side bars and the first and second rear vertical side bars are coplanar with the first and second rear cradle bars and the third and fourth rear vertical side bars.

In accordance with another aspect of the present invention upper and lower rack assemblies as described herein are stacked on top of one another such that the first, second, third and fourth male nesting members mate respectively with the first, second, third and fourth female nesting members.

The inventive rack and system can be used for the organized storage of large hoses. It can also be used for preloading hoses for deliveries and to provide quicker turnaround for drivers.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
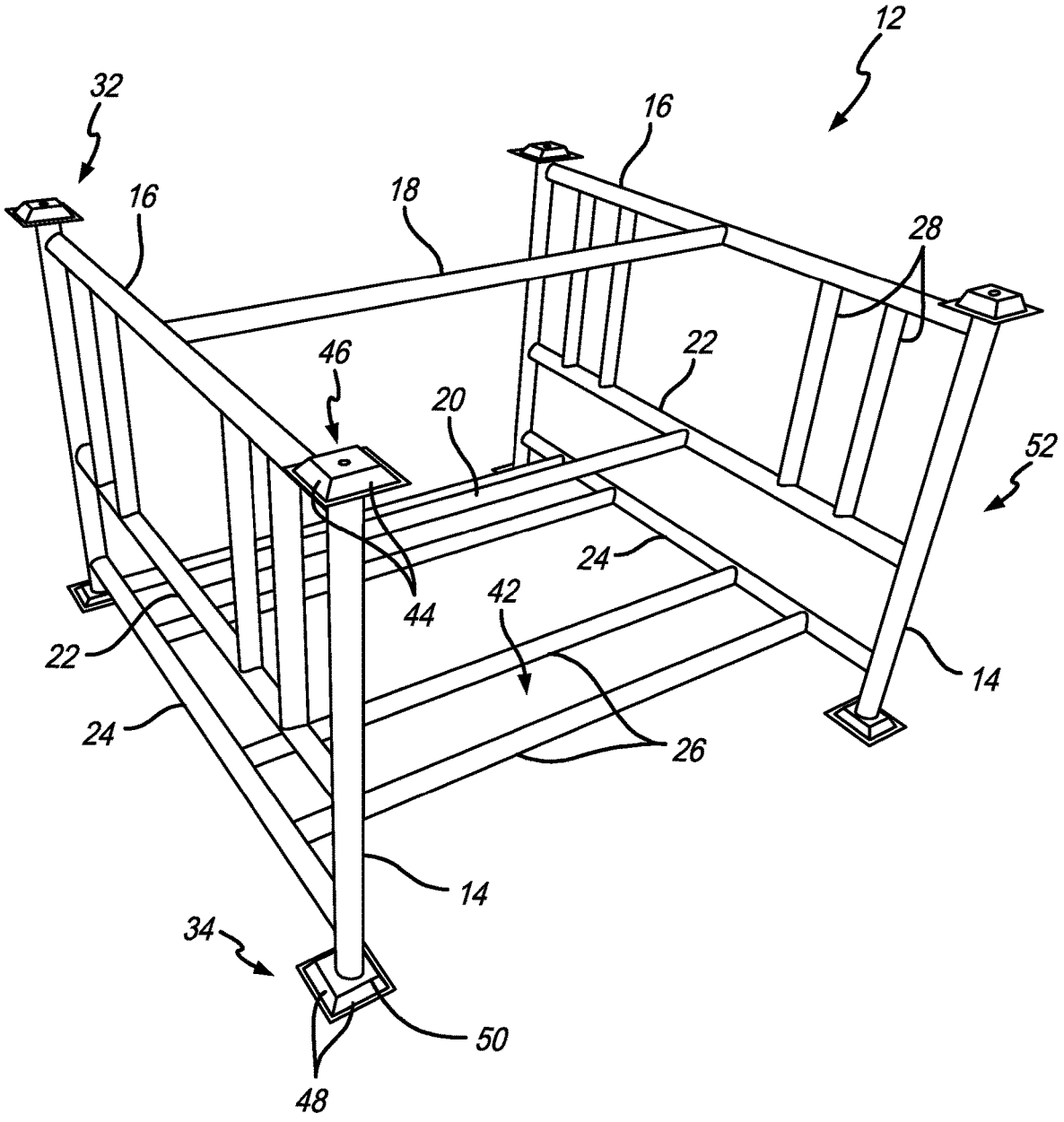
FIG. 1 is a perspective view of a rack assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments.

Reference in this specification to "one embodiment" or "an embodiment" means that a particular feature, structure, or characteristic described in connection with the embodiment is included in at least one embodiment of the-disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, the attached drawings show a rack system for storing hoses 100 in an upright position. In a preferred embodiment, the rack system 10 (best shown in FIG. 10) includes a plurality of stackable rack assemblies 12.

Figure 7:
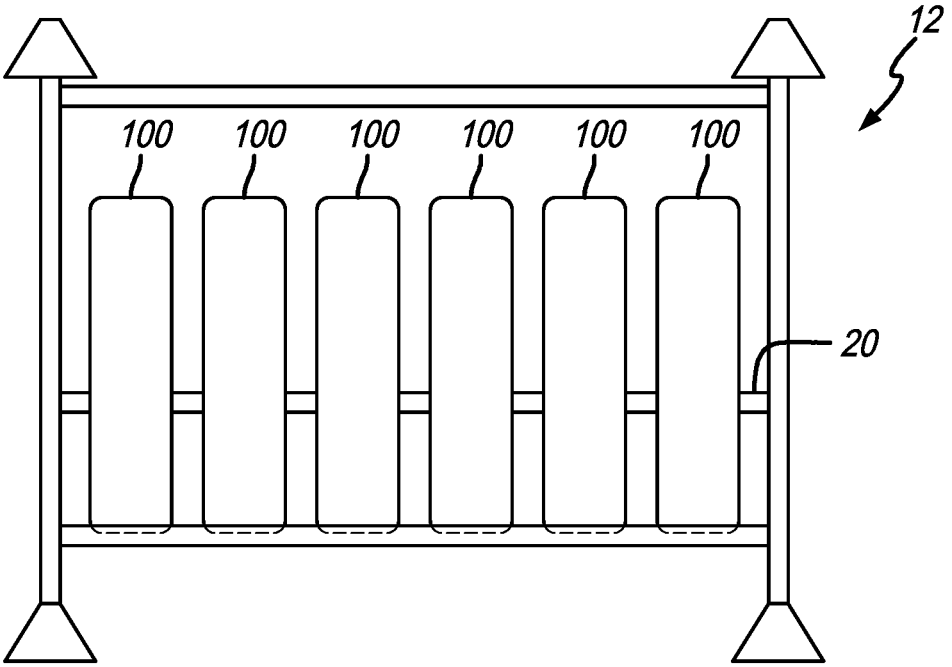
FIG. 7 is a front cross-sectional view of the rack assembly of FIG. 1 with hoses therein.
Figure 8:
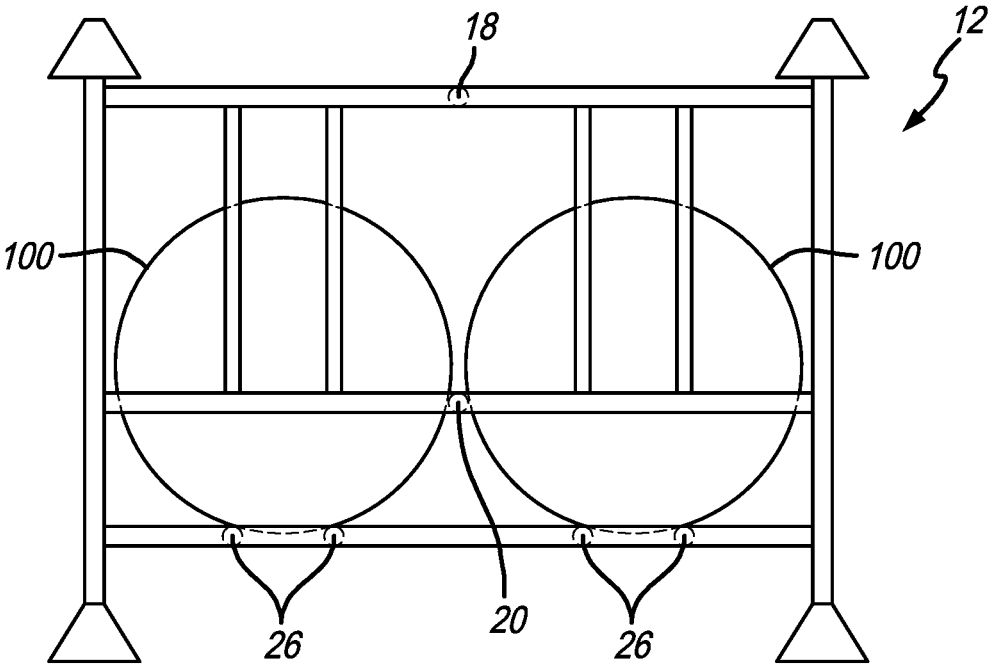
FIG. 8 is a side cross-sectional view of the rack assembly of FIG. 1 with hoses therein.
Figure 9:
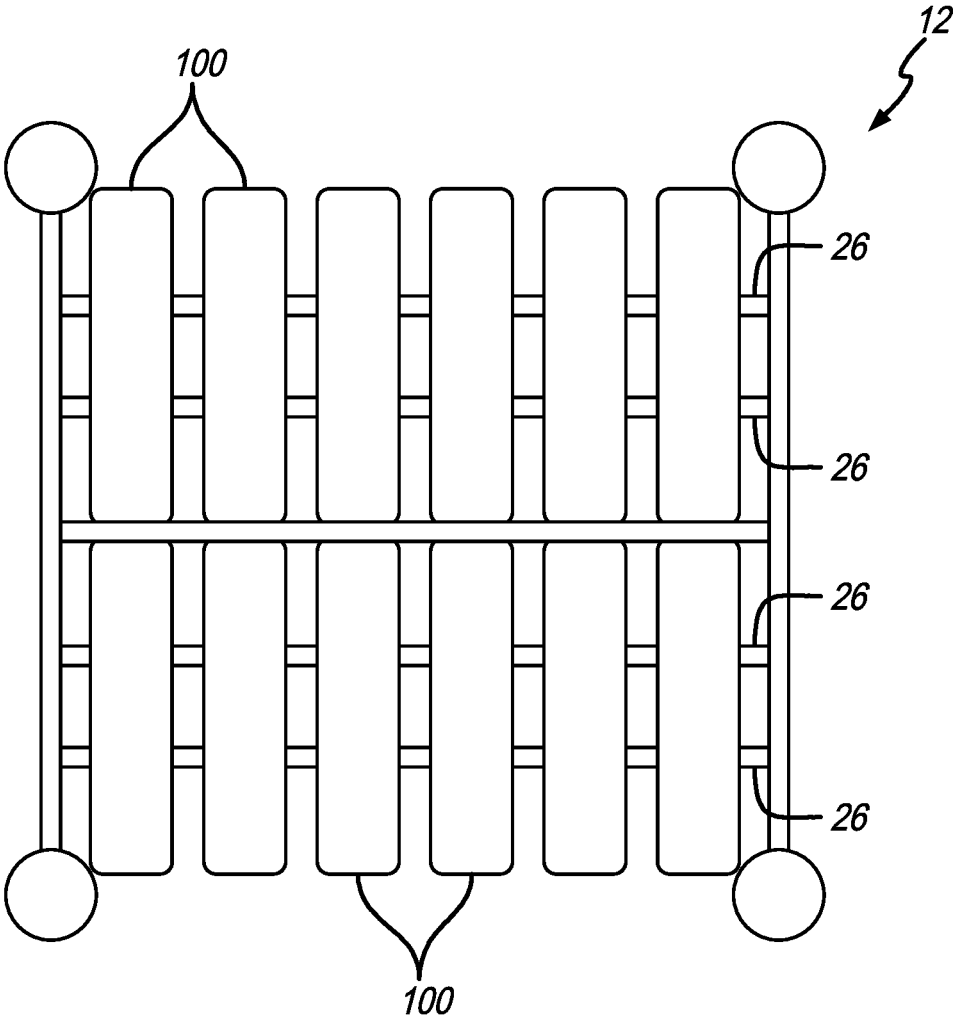
FIG. 9 is top plan view of the rack assembly of FIG. 1 with hoses therein.
Figure 10:
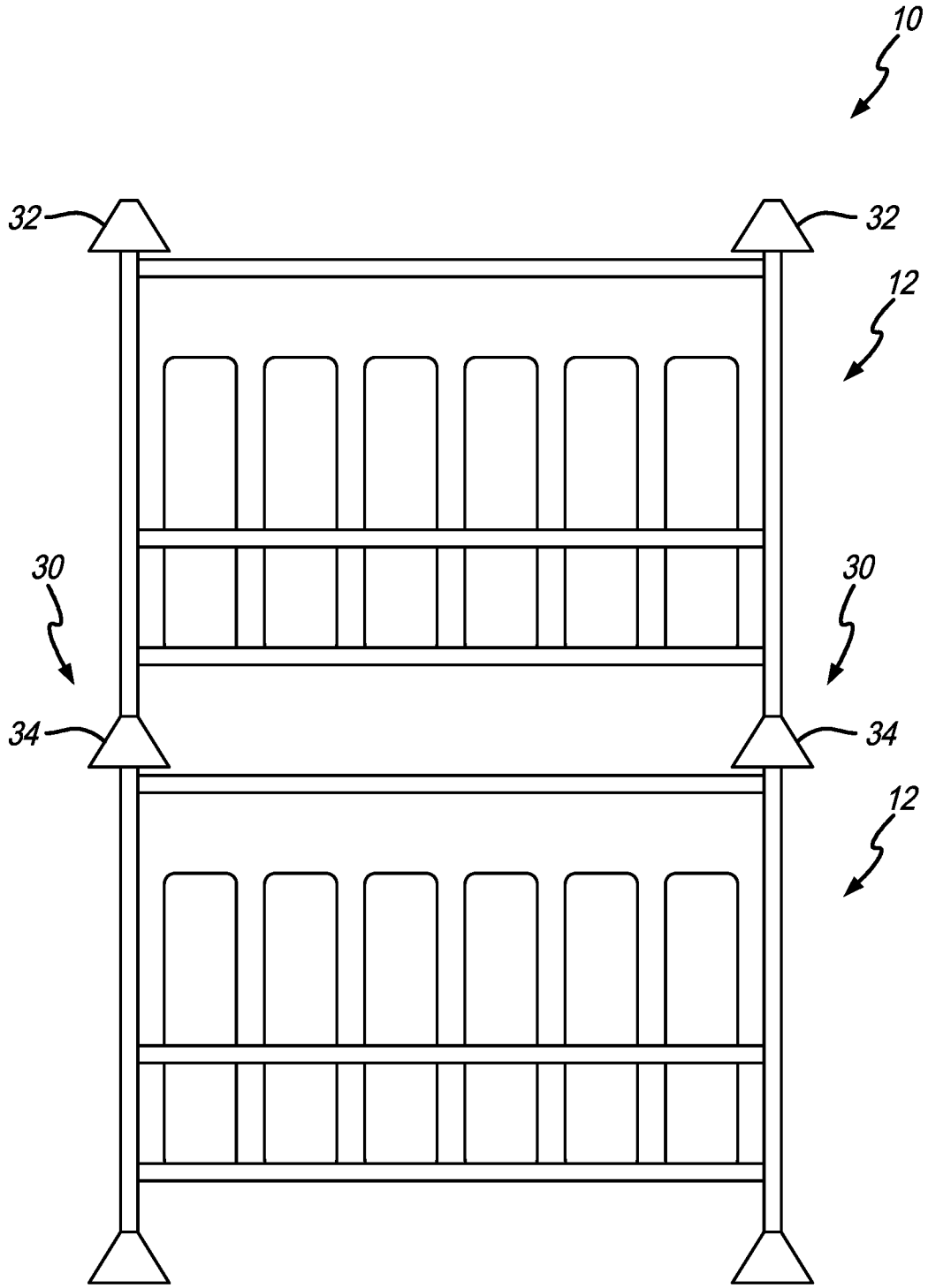
FIG. 10 is a front elevational view of two stacked rack assemblies to form a rack system.

FIGS. 1-9 show different views of a single rack assembly 12 that can be used in the stackable rack system 10 (FIG. 10). As shown in FIGS. 1-6, the rack assembly 12 includes four corner posts 14, top side bars 16, top center bar 18, mid center bar 20, mid side bars 22, bottom side bars 24, bottom cradle bars 26 and vertical side bars 28 (preferably on both sides). The bottom side and cradle bars 24 and 26 are spaced from the ground (or define a ground clearance 40) so that the forks on a fork lift can fit thereunder and lift the rack assembly 12. In another embodiment, fork pockets can be included under and/or attached to the bottom cradle bars 26 (or bottom side bars 24) to allow the forks of a forklift to fit therein. FIGS. 7-9 are the same as FIGS. 4-6, but showing how and where the hoses 100 are stacked.

As shown in FIGS. 1-3 and 6, the bottom cradle bars 26 define a cradle space 42 therebetween. In use, the hoses 100 rest on the bottom cradle bars 26 and a portion of the hoses span the cradle space 42. If the rolled hose is of a large enough diameter it may also rest against the mid center bar.

The bars and posts of the system can be made of any type of material sturdy enough to hold the hoses. In a preferred embodiment, the system is fabricated using raw steel tubing. In an alternative it can be made of galvanized steel tubing. The system can also be primer coated with the option of galvanized dipping or paint coating as a separate process. In an exemplary embodiment, the four corner posts can be 2" raw steel tubing, with the other bars being 1½" raw steel tubing. However, the dimensions are not a limitation and the posts and bars can be any desirable size. Dimensions are also shown on the drawings. It will be appreciated that the dimensions are all exemplary and not a limitation on the present invention. Any dimension for the components shown and described herein is within the scope of the present invention.

Figure 2:
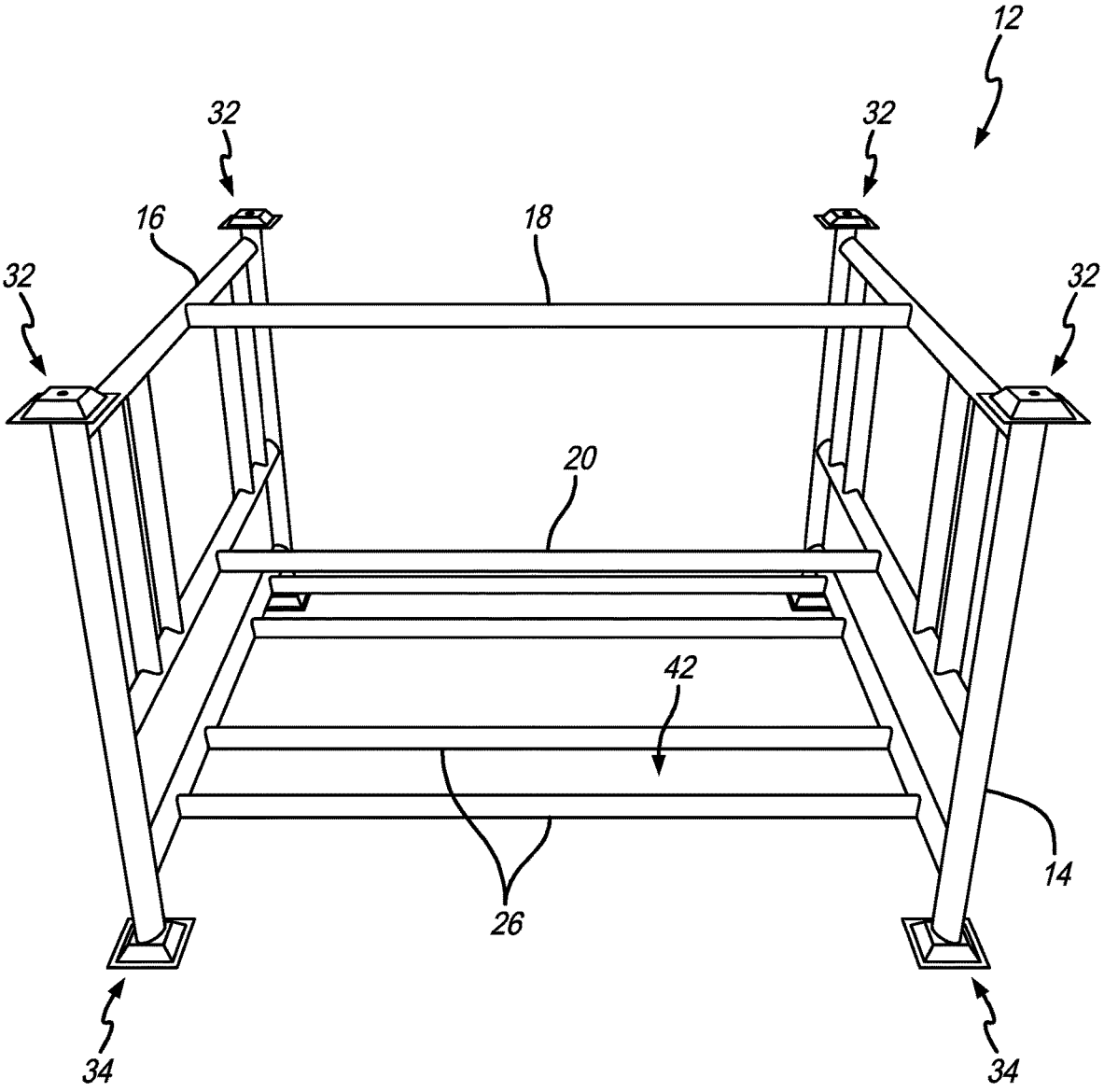
FIG. 2 is a front perspective view of the rack assembly of FIG. 1.
Figure 3:
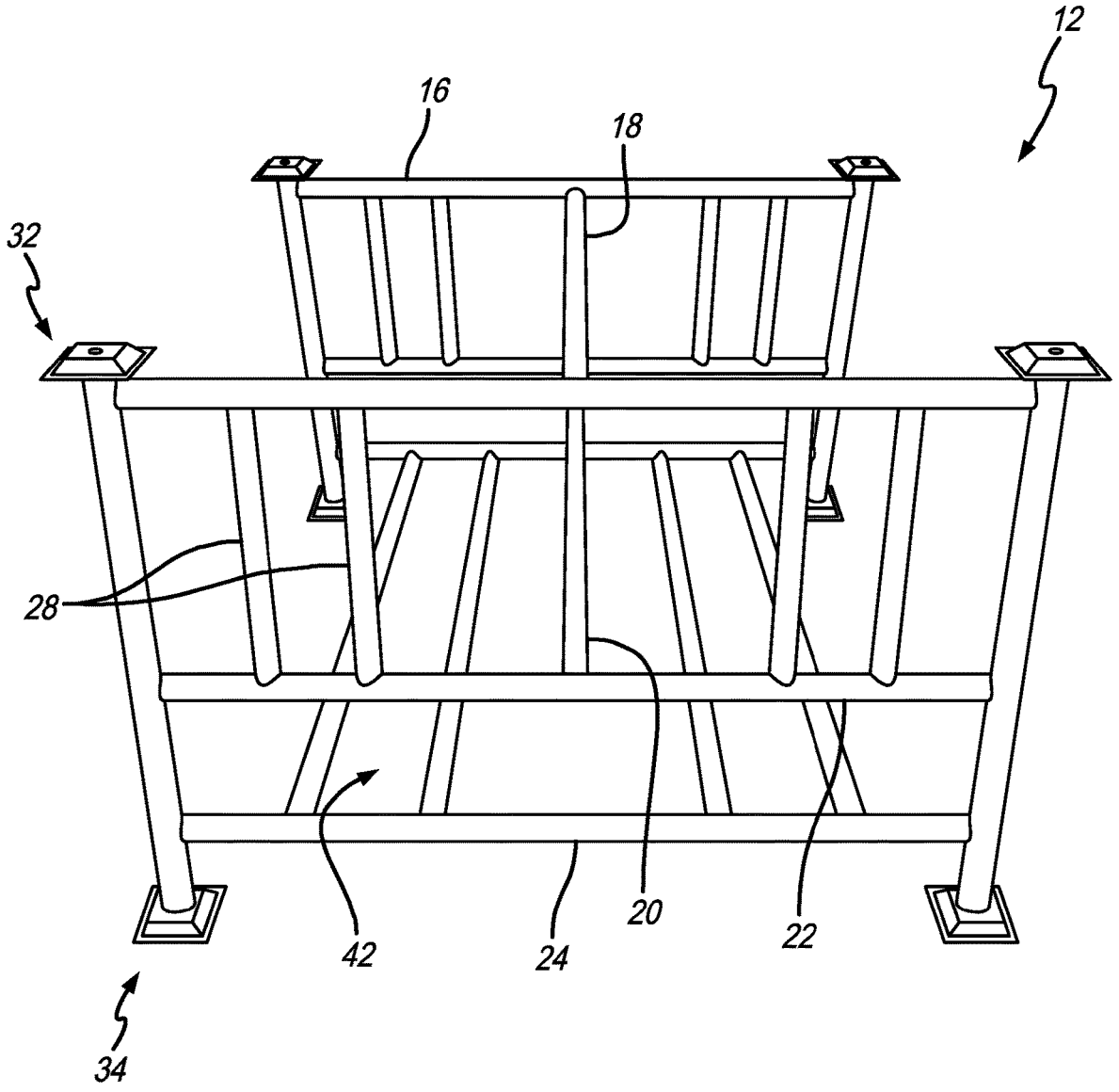
FIG. 3 is a side perspective view of the rack assembly of FIG. 1.
Figure 4:
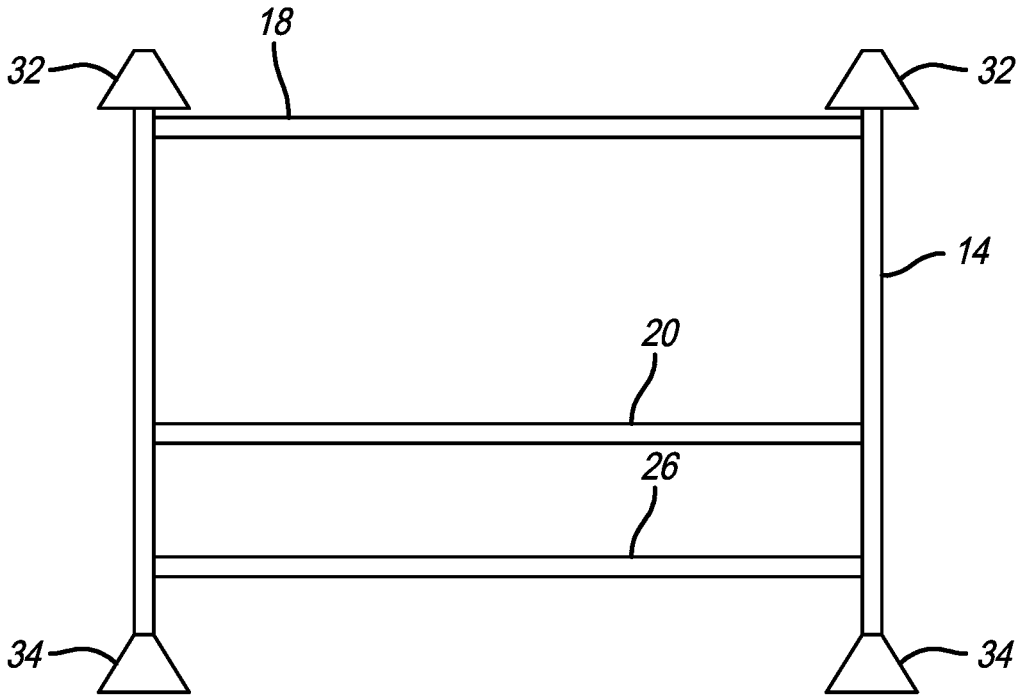
FIG. 4 is a front elevational view of the rack assembly of FIG. 1.
Figure 5:
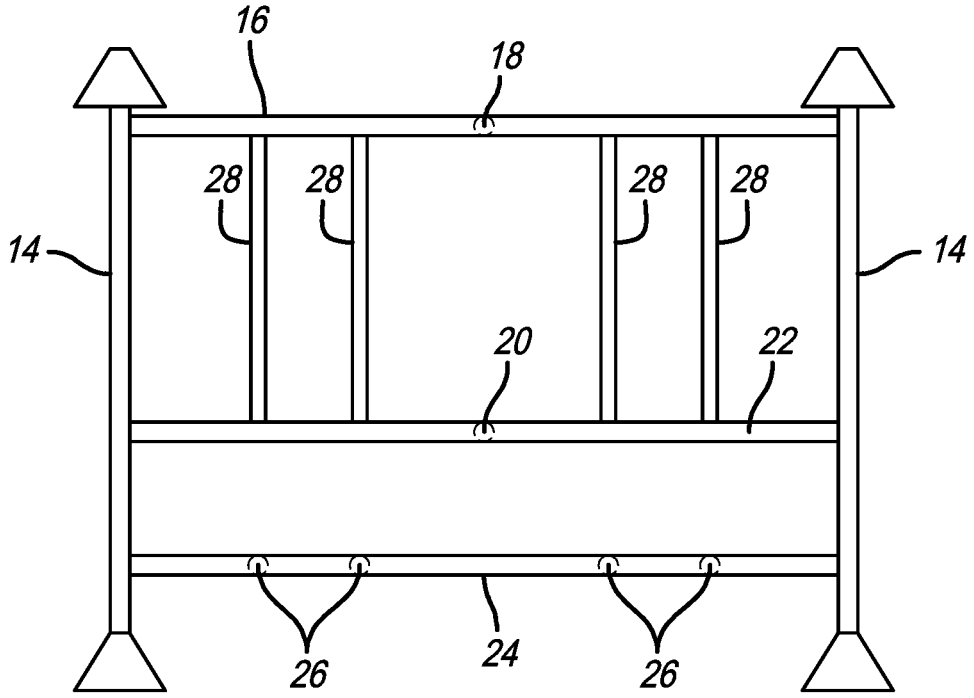
FIG. 5 is a side elevational view of the rack assembly of FIG. 1.
Figure 6:
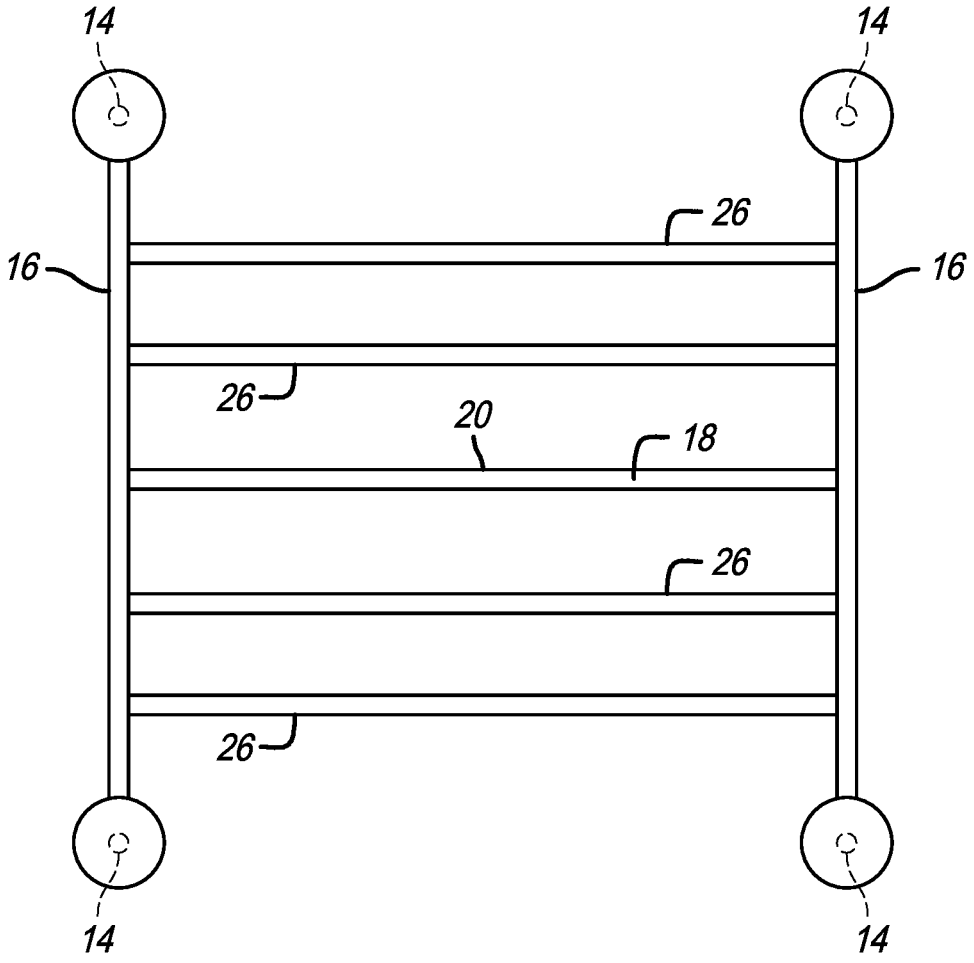
FIG. 6 is top plan view of the rack assembly of FIG. 1.

FIG. 10 shows two rack assemblies 12 stacked to form a rack system 10 with hoses 100 therein. In a preferred embodiment, the corner posts 14 including a nesting system 30 to provide stackability. The nesting system 30 can include mating male and female nesting members 32 and 34. In a preferred embodiment, the male nesting members 32 are positioned on top of the corner posts 14 and the female nesting members 34 are position on the bottom of the corner posts. As shown in FIGS. 1-3, in a preferred embodiment, the male nesting members 32 are generally convex or protrude upwardly and include four inclined surfaces 44 that extend upwardly to a generally flat or horizontal resting surface 46. The female nesting members 34 are generally concave and include four inclined surfaces 48 that extend upwardly to a generally flat or horizontal resting surface 50 (the arrows in FIG. 1 point to the top of the female nesting member 34, but it will be appreciated that the included surfaces 48 and horizontal resting surface 50 are on the bottom of the female nesting member 34). In a preferred embodiment, the male and female nesting members also include a lip or rim thereon to aid with securement in the nesting position. In another embodiment, the female nesting members can be on the top of the corner posts and the male nesting members can be on the bottom of the corner posts.

It will be appreciated that on each side of the rack assembly 12, two of the corner posts 14, the top side bar 16, the mid side bar 22, the bottom side bar 24, and the vertical side bars 28 altogether form a side wall assembly 52. Accordingly, in an embodiment, these components can all be a single wall that includes the male and female nesting members 32 and 34 on the top and bottom thereof.

Figure 11:
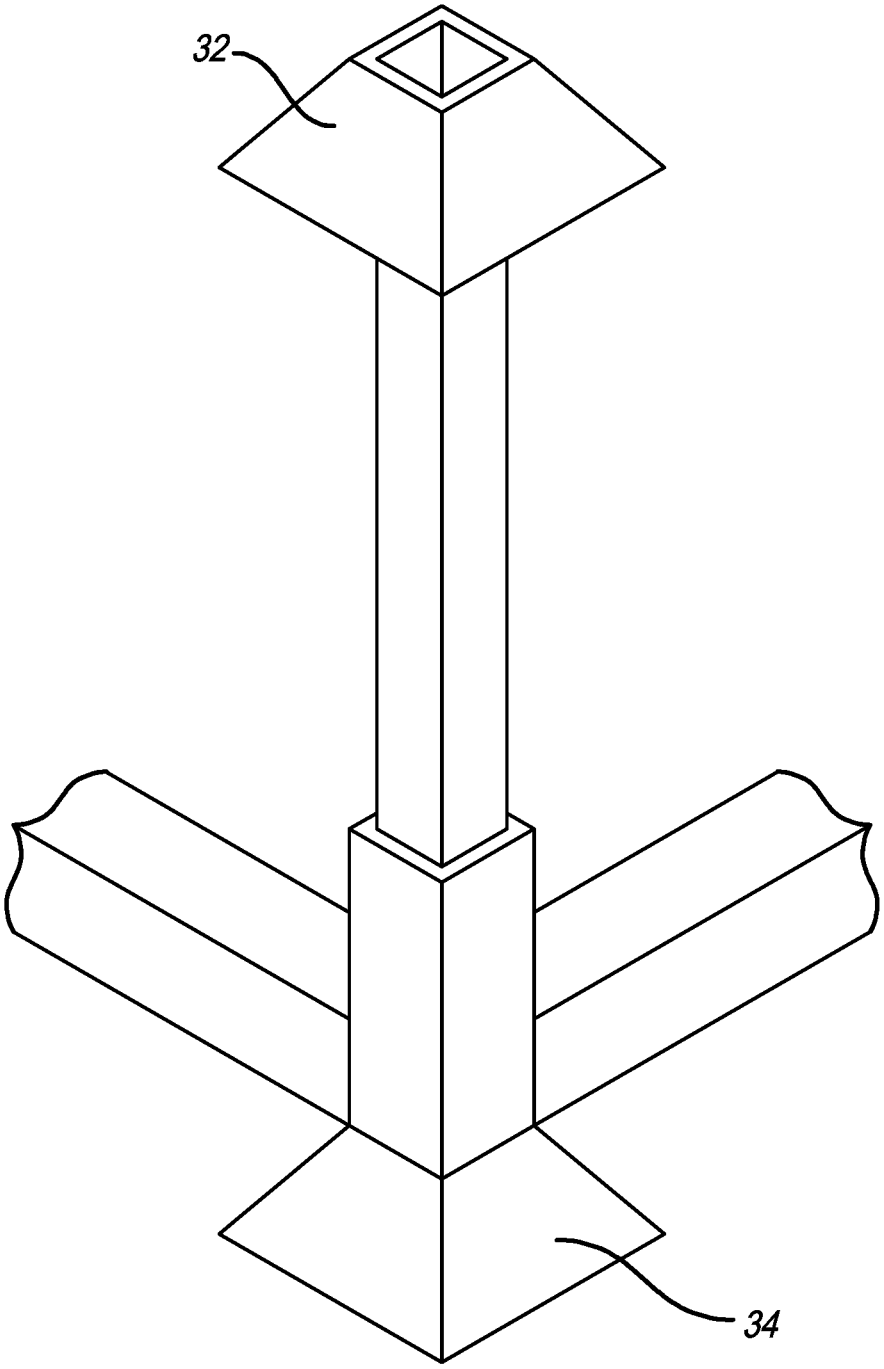
FIG. 11 is a perspective view of a rack system with another nesting system in accordance with another preferred embodiment of the present invention.
Figure 12:
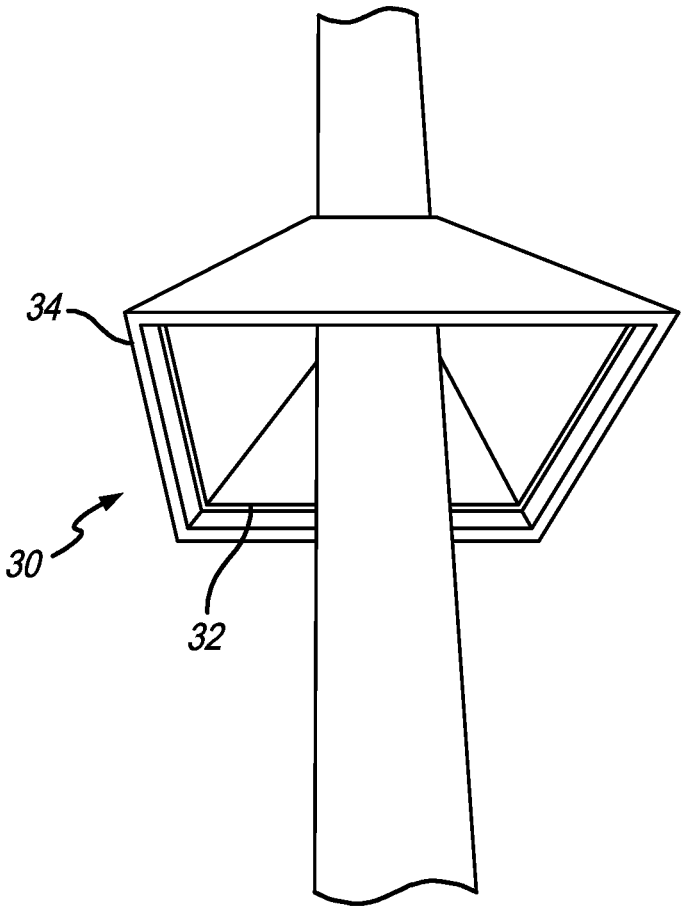
FIG. 12 is a perspective view of the nesting system of FIG. 11.

In FIGS. 4-10, wherein the male nesting members 32 include a rounded or conical shape that mates with the female nesting members 34 having a rounded or belled out bottom at the bottom of the corner post 14. FIGS. 11-12 show another embodiment of a male and female arrangement or nesting system 30 similar to that shown in FIGS. 1-3, but with steeper inclined surfaces. Any shape that allows the top and bottom members to nest or stack with one another is within the scope of the present invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

The teachings of the disclosure provided herein can be applied to other systems, not necessarily the system described above. The elements and acts of the various embodiments described above can be combined to provide further embodiments. Any measurements described or used herein are merely exemplary and not a limitation on the present invention. Other measurements can be used. Further, any specific materials noted herein are only examples: alternative implementations may employ differing materials.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A rack assembly comprising:

first and second side wall assemblies, a mid center bar extending between the first and second side wall assemblies, wherein the mid center bar is secured at its ends to a first mid side bar located within the first side wall assembly and a second mid side bar located within the second side wall assembly, and the mid center bar is disposed substantially equidistant to the ends of the first and second mid side bars, first and second front cradle bars extending between the first and second side wall assemblies, wherein a front cradle space is defined between the first and second front cradle bars, first and second rear cradle bars extending between the first and second side wall assemblies, wherein a rear cradle space is defined between the first and second rear cradle bars, first and second male nesting members secured to the top of the first side wall assembly, third and fourth male nesting members secured to the top of the second side wall assembly, and first and second female nesting members secured to the bottom of the first side wall assembly, third and fourth female nesting members secured to the bottom of the second side wall assembly, and wherein a ground clearance is defined below the first front cradle bar, second front cradle bar, first rear cradle bar and second rear cradle bar.

2. The rack assembly of claim 1 further comprising a top center bar extending between the first and second side wall assemblies, wherein the top center bar is spaced above the mid center bar.

3. The rack assembly of claim 2 wherein the first wall assembly includes first and second corner posts and a first bottom side bar that extends between the first and second corner posts, wherein the second wall assembly includes third and fourth corner posts and a second bottom side bar that extends between the third and fourth corner posts, wherein the front cradle bars extend between the first and second bottom side bars, and wherein the rear cradle bars extend between the first and second bottom side bars.

4. The rack assembly of claim 3 wherein the first mid side bar extends between the first and second corner posts, wherein the first mid side bar is spaced above the first bottom side bar, wherein the second mid side bar extends between the third and fourth corner posts, and wherein the second mid side bar is spaced above the second bottom side bar.

5. The rack assembly of claim 4 wherein the first wall assembly includes a first top side bar that extends between the first and second corner posts, wherein the first top side bar is spaced above the first mid side bar, wherein the second wall assembly includes a second top side bar that extends between the third and fourth corner posts, and wherein the second top side bar is spaced above the second mid side bar.

6. The rack assembly of claim 5 wherein the first wall assembly includes first and second front vertical side bars extending between the first top side bar and the first mid side bar, wherein the first wall assembly includes first and second rear vertical side bars extending between the first top side bar and the first mid side bar, wherein the second wall assembly includes third and fourth front vertical side bars extending between the second top side bar and the second mid side bar, and wherein the second wall assembly includes third and fourth rear vertical side bars extending between the second top side bar and the second mid side bar.

7. The rack assembly of claim 6 wherein the first and second front vertical side bars are coplanar with the first and second front cradle bars and the third and fourth front vertical side bars.

8. A rack system comprising:

a lower rack assembly that includes first and second side wall assemblies, a mid center bar extending between the first and second side wall assemblies, wherein the mid center bar is secured at its ends to a first mid side bar located within the first side wall assembly and a second mid side bar located within the second side wall assembly, and the mid center bar is disposed substantially equidistant to the ends of the first and second mid side bars first and second front cradle bars extending between the first and second side wall assemblies, wherein a front cradle space is defined between the first and second front cradle bars, first and second rear cradle bars extending between the first and second side wall assemblies, wherein a rear cradle space is defined between the first and second rear cradle bars, first and second male nesting members secured to the top of the first side wall assembly, third and fourth male nesting members secured to the top of the second side wall assembly, and first and second female nesting members secured to the bottom of the first side wall assembly, third and fourth female nesting members secured to the bottom of the second side wall assembly, and wherein a ground clearance is defined below the first front cradle bar, second front cradle bar, first rear cradle bar and second rear cradle bar, an upper rack assembly that includes first and second side wall assemblies, a mid center bar extending between the first and second side wall assemblies, first and second front cradle bars extending between the first and second side wall assemblies, wherein a front cradle space is defined between the first and second front cradle bars, first and second rear cradle bars extending between the first and second side wall assemblies, wherein a rear cradle space is defined between the first and second rear cradle bars, first and second male nesting members secured to the top of the first side wall assembly, third and fourth male nesting members secured to the top of the second side wall assembly, and first and second female nesting members secured to the bottom of the first side wall assembly, third and fourth female nesting members secured to the bottom of the second side wall assembly, wherein the first male nesting member of the lower rack assembly is nested with the first female nesting member of the upper rack assembly, wherein the second male nesting member of the lower rack assembly is nested with the second female nesting member of the upper rack assembly, wherein the third male nesting member of the lower rack assembly is nested with the third female nesting member of the upper rack assembly, wherein the fourth male nesting member of the lower rack assembly is nested with the fourth female nesting member of the upper rack assembly.

* * * * *